United States Patent [19]

Tanaka et al.

[11] 4,021,109

[45] May 3, 1977

[54] ELECTROPHOTOGRAPHIC COPYING APPARATUS

[75] Inventors: Hidetoshi Tanaka, Musashino; Tadashi Sato, Kokubunji; Toshiro Kasamura, Kawasaki, all of Japan

[73] Assignee: Canon Kabushiki Kaisha, Tokyo, Japan

[22] Filed: Aug. 29, 1975

[21] Appl. No.: 609,097

[30] Foreign Application Priority Data

Sept. 2, 1974 Japan ..... 49-100672

[52] U.S. Cl. ..... 355/8; 358/300

[51] Int. Cl.[2] ..... G03G 15/28

[58] Field of Search ..... 355/8, 11, 3SC, 66; 178/7.6

[56] References Cited

UNITED STATES PATENTS

| | | | |
|---|---|---|---|
| 3,419,327 | 12/1968 | Oikawa et al. | 355/8 |
| 3,512,886 | 5/1970 | Wirley et al. | 355/8 X |
| 3,524,928 | 8/1970 | Hoskins | 355/8 X |
| 3,640,616 | 2/1972 | Egnaczak et al. | 355/8 |
| 3,876,302 | 4/1975 | Todt | 355/8 X |

*Primary Examiner*—Richard L. Moses

*Attorney, Agent, or Firm*—Fitzpatrick, Cella, Harper & Scinto

[57] ABSTRACT

An electrophotographic copying apparatus for forming on a photosensitive medium electrostatic images corresponding to an original image and for providing copies thereof, comprises an original carriage for carrying thereon the original image, optical scanning means having a plurality of reciprocally movable scanning units for scanning the original image on the carriage, a photosensitive medium, and means for forming on the photosensitive medium electrostatic images corresponding to the original image. The optical scanning units of the optical scanning means are operable to successively scan the original image.

7 Claims, 19 Drawing Figures

ELECTROPHOTOGRAPHIC COPYING APPARATUS

BACKGROUND OF THE INVENTION

1. Field of the Invention

This invention relates to an electrophotographic copying apparatus for effecting high-speed copyinng, and more particularly to an electrophotographic copying apparatus having an optical scanning device for continuously scanning an original image at high speed.

2. Description of the Prior Art

Heretofore, when a number of copies of an orginal were to be produced by an electrophotographic copying apparatus, the original was repetitively exposed to light to form an image on a photosensitive medium at each exposure, thereby providing a predetermined number of copies. For a number of copies to be produced at high speed, the exposure time must be shortened and the image formation speed increased. On the other hand, a novel electrophotographic method heretofore proposed and the advent of improved photosensitive medium have given rise to the possibility of retention copying which eliminates the necessity of exposing the original image to light each time in order to obtain a number of copies.

Retention copying is so called because an electrostatic latent image once formed by the exposure of an original image to light is retained for repeated use in the formation of copy images. During the repeated copy image formation, there is no need to carry out the latent image formation by the exposure of the original image to light and accordingly, the total copying time may of course be shortened. Again in this case, the time required for the original image to be exposed to light to form a latent image must be shortened for the speed-up of the copying operation. Also, the slit exposure system is suitable for high-speed copying, whatever type of electrophotographic process may be adopted. According to such system, the photosensitive medium in use is only required to secure an exposure area corresponding to the slit width and thus need not provide an area of plane for one whole image at the exposed location of the medium. This leads to the possibility that the photosensitive medium may assume a cylindrical or other desired configuration. In the slit exposure system, however, the optical system for scanning an original image scans the original during its forward stroke, and then must return to its initial position to start another scanning cycle. Such return to the initial position takes a finite period of time which, even if it could be reduced to the equal of or a fraction of the time required for the forward stroke, would be still limited in reduction by the requirement of mechanical accuracy and would form an obstacle against the speed-up of the copying operation.

The present invention solves the problems related to above-noted points.

SUMMARY OF THE INVENTION

It is an object of the present invention to provide an electrophotographic copying apparatus which enables high-speed copying.

It is another object of the present invention to provide a high-speed electrophotographic copying apparatus which uses a photosensitive medium capable of effecting retention copying.

It is still another object of the present invention to provide an element forming a high-speed electrophotographic copying apparatus, especially an improved optical scanning device capable of scanning an original image a number of times.

Generally describing the present invention, copy images may be obtained by the so-called retention copying process wherein a plurality of reciprocally movable optical scanning units for scanning an original image are successively moved forward to effect the scanning to thereby continuously form electrostatic images on a photosensitive medium, each of which electrostatic images is developed and transferred onto a a transfer medium or is repetitively used to form corresponding electrostatic images which in turn are developed and transferred to provide copy images.

The above objects and other features of the present invention will become more fully apparent from the following detailed description of some specific embodiments taken in conjunction with the accompanying drawings.

DESCRIPTION OF THE PREFERRED EMBODIMENTS

Figure 1:
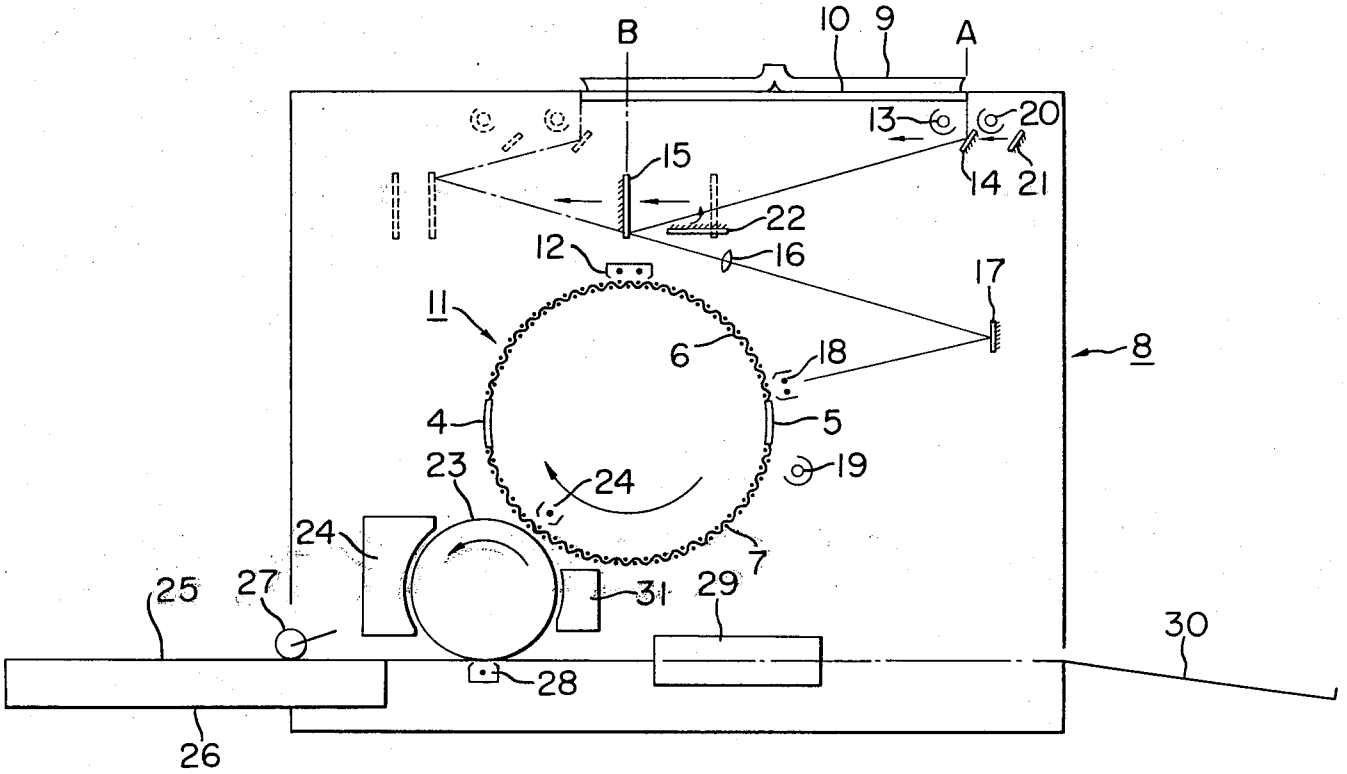
FIG. 1 is a schematic side view of a specific embodiment of the electrophotographic copying apparatus according to the present invention.
Figure 2:
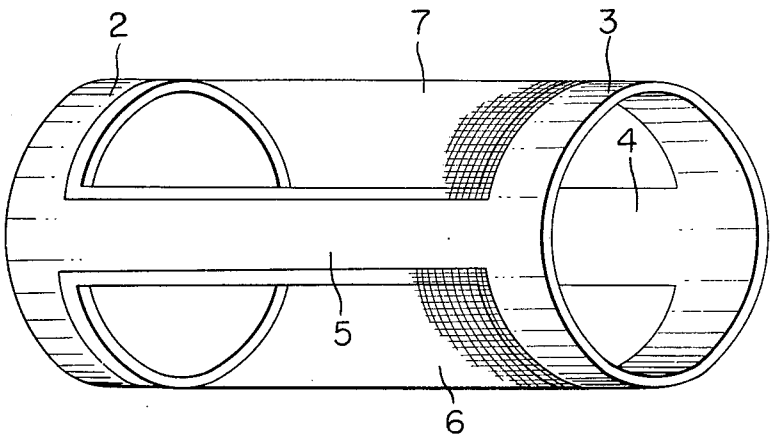
FIG. 2 is a perspective view of a photosensitive screen medium used with the specific embodiment of the present invention.

FIG. 1 shows a specific embodiment of the copying apparatus according to the present invention. This embodiment is of a construction which enables retention copying, and employs a photosensitive screen drum designed as shown in FIG. 2. The photosensitive drum 11 comprises a cylindrically shaped support frame provided with symmetrically openings which are covered with photosensitive screens 6 and 7. Thus, the cylindrically shaped support frame comprises wheels 2 and 3 at the opposite ends and connecting belts 4 and 5 therebetween. The construction in which the photosensitive screens are disposed symmetrically with each other as shown will provide a balanced tension which will be convenient in terms of structural strength.

Such form of photosensitive screen medium and the image forming process using the same are disclosed, for example, in U.S. Pat. No. 3,645,614 by S.B. McFarlane, Jr. et al. or in U.S. application Ser. No. 480,280 by K. Ohara et al. which will hereinafter be described in conjunction chiefly with FIGS. 3A–3D.

The screen 1 shown in FIGS. 3A–3D comprises a conductive member C having a number of tiny openings, and a photoconductive member P and an insulating member *i* successively layered over the conductive member with part of the conductive member exposed.

The conductive member C may be prepared by etching a plate of metal such as stainless steel or nickel to form the tiny openings or by electroplating such a plate or by knitting a metal wire into the form of netting. The mesh value of the conductive member C may preferably be 100 to 400 meshes from the viewpoint of resolving power, if it is directed to the purpose of copying. The photoconductive member P may be formed by evaporating Se-alloy or the like or by spray-coating a dispersion of insulative resin material having particles of CdS, PbO or the like. The insulating member *i* may be formed by spraying or vacuum-evaporating a material solvent of organic insulator, such as epoxy-resin, acrylic resin, silicone resin or the like. In the shown example, the photoconductive member P uses a semiconductor formed of Se or its alloy with positive pores as the main carrier and having such a characteristic that the positive pores are filled even in dark regions.

Figure 3A:
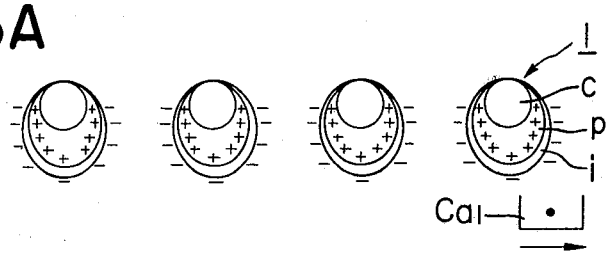
FIGS. 3A–3D diagrammatically illustrate, in sequence, the operational steps performed by apparatus whereby image formation is effected on the photosensitive screen medium.

FIG. 3A shows the step of applying a primary voltage, in which the surface of the insulating member *i* is uniformly charged to the negative polarity by charger means $Ca_1$ such as a corona discharger or the like. The introduced charges of the opposite polarity are captured at the interface between the insulating member *i* and the photoconductive member P.

Figure 3B:
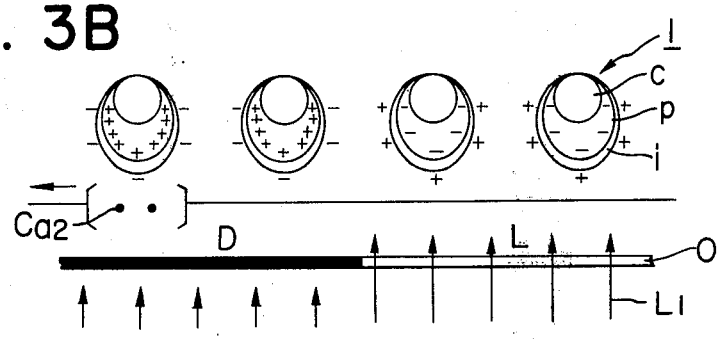

FIG. 3B shows the step of applying an image light and a secondary voltage simultaneously. In the shown example, an original of the transmission type is irradiated with light and the light is intercepted in the dark region D of the original while the light passes through the light region L to reach the photosensitive medium. The screen 1 has its surface potential substantially nullified or charged positively by a corona dischargr $Ca_2$ which effects positively biased AC discharging or secondary charging of the opposite polarity to the primary charging. On the other hand, the charge distribution over the surface of the screen becomes such that most of the negative charges, if some of them disappear, exist in the region of the screen corresponding to the dark region D of the original while negative charges are erased and positive charges exist in the region of the screen corresponding to the light region L of the original. In this manner, a primary electrostatic latent image is formed on the screen 1. This image increases its electrostatic contrast with time or with allover exposure.

Figure 3C:
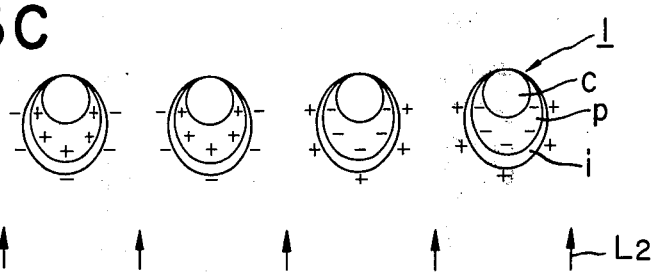

FIG. 3C shows the step of overall exposure in which the entire surface of the screen 1 is exposed to light $L_2$. This overall exposure does not greatly vary the surface potential of the screen 1 in the light region while it rapidly varies the surface potential in the dark region to a level corresponding to the quantity of surface charge on the insulating member *i*, thus increasing the contrast.

Figure 3D:
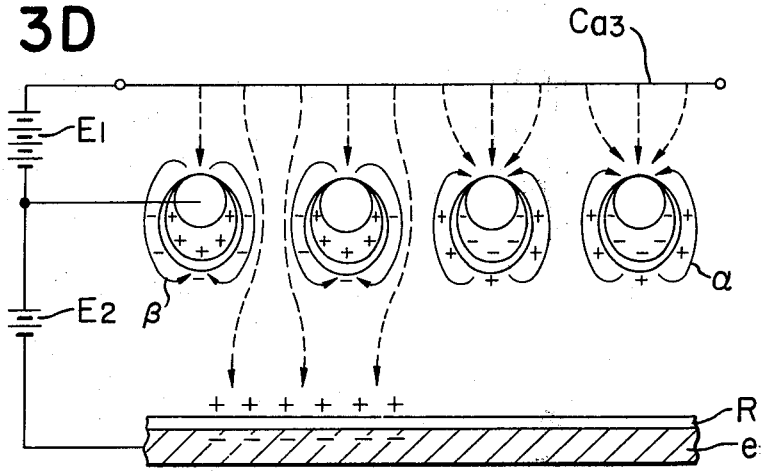

FIG. 3D shows the manner in which corona ion flows are modulated by the primary electrostatic latent image formed on the screen 1 to form on a recording member a positive electrostatic latent image corresponding to the original image. In the FIGURE, $Ca_3$ designates a discharger corona wire, *e* an electrode member, R a recording member capable of retaining charges thereon, and $E_1$ and $E_2$ denote power sources. The recording member R is disposed adjacent to the insulating member *i* of the screen 1, while the wire $Ca_3$ is disposed adjacent to the exposed conductive member C of the screen 1, and the corona ion flow from the wire $Ca_3$ are directed toward the recording member R with a potential difference provided between the wire $Ca_3$ and the electrode member *e*. In the light regions of the screen, fields as indicated by solid lines $\alpha$ are then created by the charges forming the primary electrostatic latent image. By these fields, the ion flow indicated by broken lines is prevented from passing through the screen and caused to flow to the exposed conductive member C. In the dark regions of the screen 1, on the other hand, fields as indicated by solid lines $\beta$ are created so that the ion flow, in spite of its being opposite in polarity to the primary electrostatic latent image, reaches the recording member R without negating the electrostatic latent image.

According to the above-described method, the primary electrostatic latent image is formed on the insulating layer and this may increase the electrostatic contrast. Moreover, the formed electrostatic image suffers little from charge attenuation, which in turn leads to be possibility of retention copying, that is, formation of a secondary electrostatic image corresponding to the primary electrostatic image on a number of recording members.

The apparatus of FIG. 1 is designed to carry out the above-described image formation process. An original 9 to be illuminated and scanned is placed on an original carriage 10 having a transparent glass plate or the like provided on top of a copying apparatus 8.

A photosensitive drum 11 is rotated at a predetermined velocity, in the indicated direction and first uniformly charged to a desired polarity (for example, the positive (+) polarity).

The original 9 is scanned by first optical scanning means driven in synchronism with the movement of the photosensitive screen medium, the first optical scanning means including first and second movable mirrors 14 and 15 movable in the same direction at a velocity ratio of 2 : 1, and an illuminating lamp 13 movable with the first mirror. The image of the original 9 is passed through a lens 16 and via a stationary mirror 17 and projected upon the surface of the screen 6 on the photosensitive drum. The surface of the screen 6 is subjected to AC charge by a corona discharger 18 simultaneously with the image projection, and then to allover exposure by a lamp 19, whereby a primary electrostatic latent image corresponding to the original 9 is formed and retained on the screen 6.

Subsequently, second optical scanning means, comprising a combination of lamp 20 and first movable mirror 21 and a second movable mirror 22 movable in the same direction at a velocity ratio of 2 : 1 in accordance with the rotation of the photosensitive drum 11, scans the original 9 in synchronism with the screen 7 and projects the image of the original through the lens 16 and via the mirror 17 onto the screen 7, and then the screen 7 is simultaneously subjected to AC charge by the corona discharger 18 and allover exposure by the lamp 19, whereby a primary electrostatic latent image corresponding to the original 9 is formed on the screen 7. Thus, two primary electrostatic latent images each corresponding to the original 9 are continuously formed on the two screens 6 and 7 extended over two locations in the cylindrically shaped frame member.

Next, a cylindrically shaped member 23 closely adjacent to the photosensitive drum 11, which has a surface formed of an insulating layer and is rotatable in the same direction and at the same tangential velocity as the drum 11, is charged to a predetermined polarity (for example, the negative (−) polarity) through the screen by a corona discharger 24 provided inside the cylindrically shaped frame member, whereby a secondary electrostatic latent image corresponding to the primary electrostatic latent image is formed on the surface of the cylindrically shaped member 23. The secondary electrostatic latent image thus formed on the cylindrically shaped member 23 is developed by a developing device 24 to form a developed toner image. A sheet of transfer paper 25 is fed from a paper supply table 26 by means of a pickup roller 27 and transported in synchronism with the toner image on the cylindrically shaped member 23, so that the toner image is transferred onto the transfer paper by a transfer charger 28, whereafter the transferred image is fixed by a fixing device 29 and enters a tray 30, thus completing a cycle of copying. After the image transfer, the cylindrically shaped member 23 has any residual toner and charges removed therefrom by a cleaning device 31 so as to be ready for the formation of another secondary electrostatic image.

Such step of secondary electrostatic latent image formation and incidental procedures may be repeated to produce a number of copies. During the step of secondary electrostatic latent image formation, it will also be effective to vary the rotational velocity of the drum from that during the step of primary electrostatic latent image formation.

In FIG. 1, the positions of the mirrors before scanning are indicated by solid lines and those after scanning are indicated by broken lines.

Figure 4A:
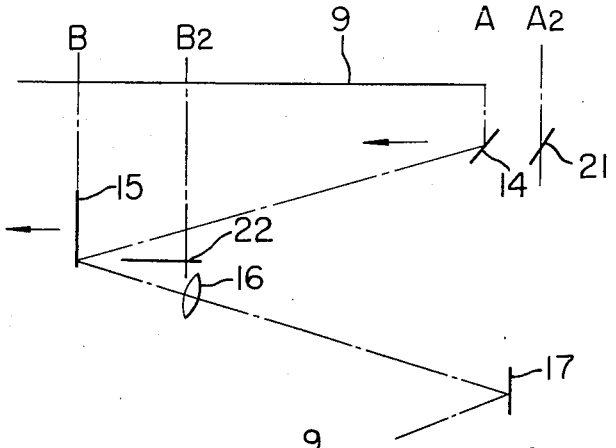
FIGS. 4A–4E diagrammatically illustrate in sequence the movement of the optical scanning system.

FIGS. 4A–4E diagrammatically llustrate the operation of the above-described optical scanning means.

a. The first and second movable mirrors 14 and 15 of the first optical scanning means are moved in the same direction, as depicted in FIGS. 4A, and at a velocity ratio of 2 : 1, in synchronism with the screen 6 on the cylindrically shaped frame member, thereby scanning the original 9.

Figure 4B:
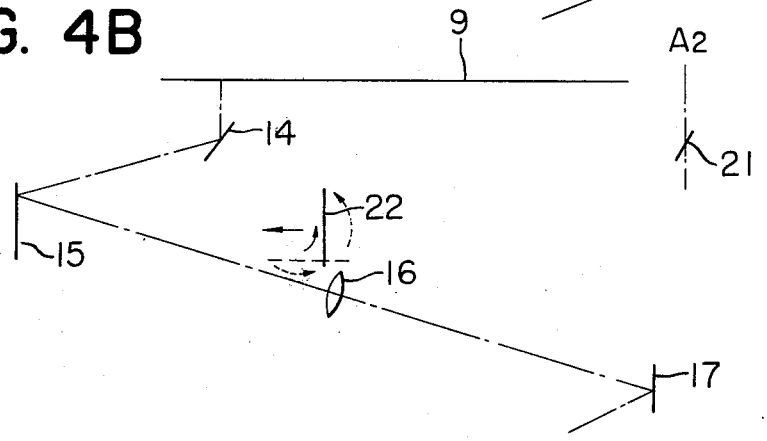
Figure 4C:
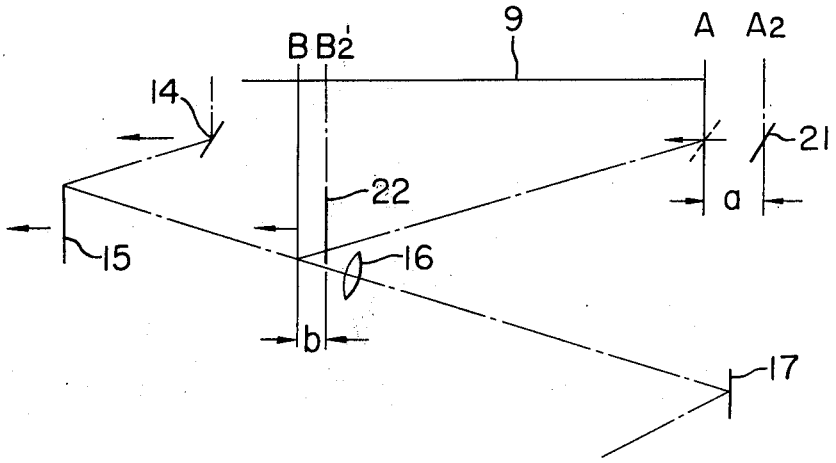
Figure 4D:
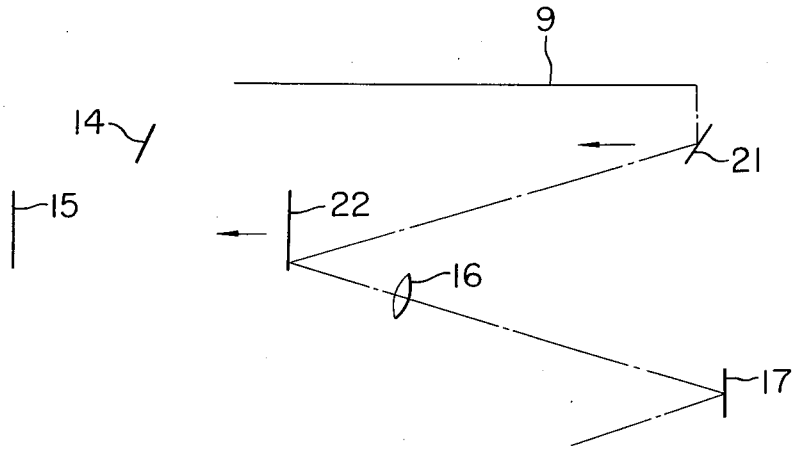
Figure 4E:
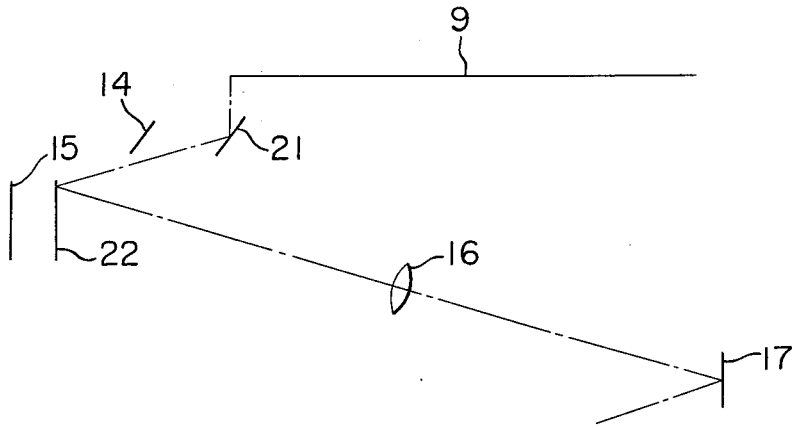

When this occurs, the second optical scanning means is is its waiting position, as shown, with the first movable mirror 21 thereof being at a position $A_2$ beyond the range of the original 9, and the second movable mirror 22 being rotated at a position $B_1$ so as to be parallel to the plane of the original in order not to intercept the light path for the first optical scanning means.

b. When the first optical scanning means comes near the end of its scanning of the original 9, as shown in FIG. 4B, the second movable mirror 22 of the second optical scanning means is rotated so as not to cross the light path and starts to move.

c. The first optical scanning means terminates its scanning of the original but still continues to move as shown in FIG. 4C. The second movable mirror 22 of the second optical scanning means comes to a position $B_2'$, whereupon the first movable mirror 21 starts to move at a velocity double that of the second movable mirror 22. Upon arrival of the first and second movable mirrors 21 and 22 at their respective positions A and B, the second optical scanning means starts to illuminate and scan the original. Therefore, the distance $a$ between the positions A and $A_2$ and the distance $b$ between the positions B and $B_2'$ are in the relation that $a=2b$.

d. The first optical scanning means comes to halt at the position shown in FIG. 4D. The first and second movable mirrors 21 and 22 of the second optical scanning means are moved in the same direction but at a velocity ratio of 2 : 1 in synchronism with the other screen 7 on the cylindrically shaped frame member, thereby scanning the original.

e. When the second optical scanning means terminates its scanning of the original, as shown in FIG. 4E, the second and the first optical scanning means return to their respective initial positions.

Figure 5:
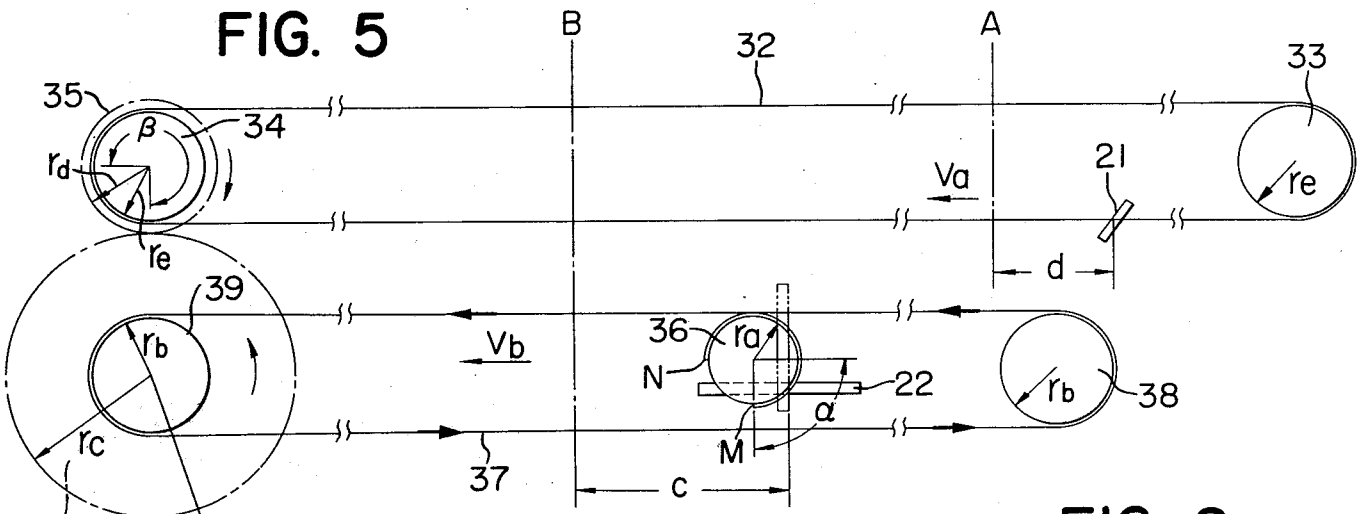
FIG. 5 is a diagrammatic illustration of a specific moving mechanism for the optical scanning system.

FIG. 5 illustrates an example of the drive for the second optical scanning means in greater detail.

This example particularly pertains to a method of the type whereby the first and second movable mirrors 21 and 22 are simultaneously moved to their scanning start positions. A length of wire 32 is secured at one point to the first movable mirror 21 and extends between and over two pulleys 33 and 34 each having a radius $r_e$.

The pulley 33 is rotatably mounted on a shaft. The other pulley 34 is mounted coaxially with a gear 35 having a pitch radius $r_d$ and is connected thereto with an angle of play $\beta$, so that initial rotation of the gear 35 in the direction of the arrow through the angle $\beta$ causes no rotation of the pulley 34, but further rotation of the gear 35 drives to rotate the pulley 34 in the same direction and at the same angular velocity as the gear. The rotation of the pulley 34 in turn moves the wire, thus driving the first movable mirror 21 in the direction of the arrow (at a velocity V$a$). The distance between the initial position of the first movable mirror 21 and its scanning start position for the original 9 (see FIG. 4) is represented by $d$.

A pulley 36 having a radius $r_a$ is attached to the second movable mirror 22, and a length of wire 37 has one end thereof secured to the pulley 36 at a point M. The wire 37 extends between and over two pulleys 38 and 39 and the other end of the wire is also secured to the pulley 36 at a point N.

The pulley 38 is rotatably mounted on a shaft. The other pulley 39 is coaxial with a gear 40, which is in meshing engagement with the gear 35, and secured to the gear 40, so that rotation of the gear 40 in the direction of the arrow causes the pulley 39 to be rotated in the same direction and at the same angular velocity as the gear 40 to thereby move the wire 36 in the direction of the arrow. The pulley 36 is mounted on the second movable mirror 22 for rotation through an angle $\alpha$, so that rotation of the pulley 36 causes the second movable mirror 22 to be rotated through the angle $\alpha$.

As the wire 37 is moved by the pulley 39 as described above, the second movable mirror 22 is initially rotated through the angle $\alpha$, and further movement of the wire 37 drives the second movable mirror 22 in the directin of the arrow (at a velocity V$b$).

The distance between the initial position of the second movable mirror (the position of the mirror after it is rotated) and the scanning start position B for the original (see FIG. 4) is represented by $c$.

With the rotation of the photosensitive drum, the gear 40 is caused by a clutch $CL_1$ 41 to start its rotaion in the direction of the arrow (counter-clockwise). Therewith, the gear 35 is rotated in the direction of the arrow (clockwise). The rotation of these two gears 40 and 35 causes the pulley 36 to be first rotated to rotate the second movable mirror 22 to its vertical position, and then the mirror 22 starts to move horizontally. When the second movable mirror 22 comes to a predetermined position (namely, the position as far as $d/2$ from B), the gear 35 starts to rotate the pulley 34 and also starts to move the first movable mirror 21. The first 21 and the second movable mirror 22 reach their scanning positions at the same time, thus starting to scan the original 9.

At the end of the scanning of the original, the clutch $CL_1$41 is released to bring the mirrors 21 and 22 to a halt. Subsequently, the gear 40 is reversely rotated by a clutch $CL_2$42. The reverse rotation of the clutch 40 also causes reverse rotation of the gear 35. By the reverse rotation of the gear 40, both the pulley 39 and the wire 37 are reversely rotated to bring the second movable mirror 22 to its horizontal position and thereafter move it reversely. During the reverse rotation of the gear 35 through the angle $\beta$, the pulley 34 remains stationary, but further rotation of the gear 35 drives to rotate the pulley 34 reversely and move the wire reversely, thus moving the first mirror 21 in the reverse direction. In this manner, the first and second movable mirrors 21 and 22 are returned to their initial positions. During such scanning, however, in order that the first 21 and the second movable mirror 22 may be moved at a velocity ratio of 2 : 1 and reach their respective scanning start positions simultaneously, the following relations are required.

$$r_e r_c = 2 r_b r_d \quad (1)$$

$$c + r_a \alpha = \tfrac{1}{2}(d + r_e \beta) \quad (2)$$

FIGS. 6 to 9 illustrate a specific example of the driving mechanism for the movable mirrors.

Figure 6:
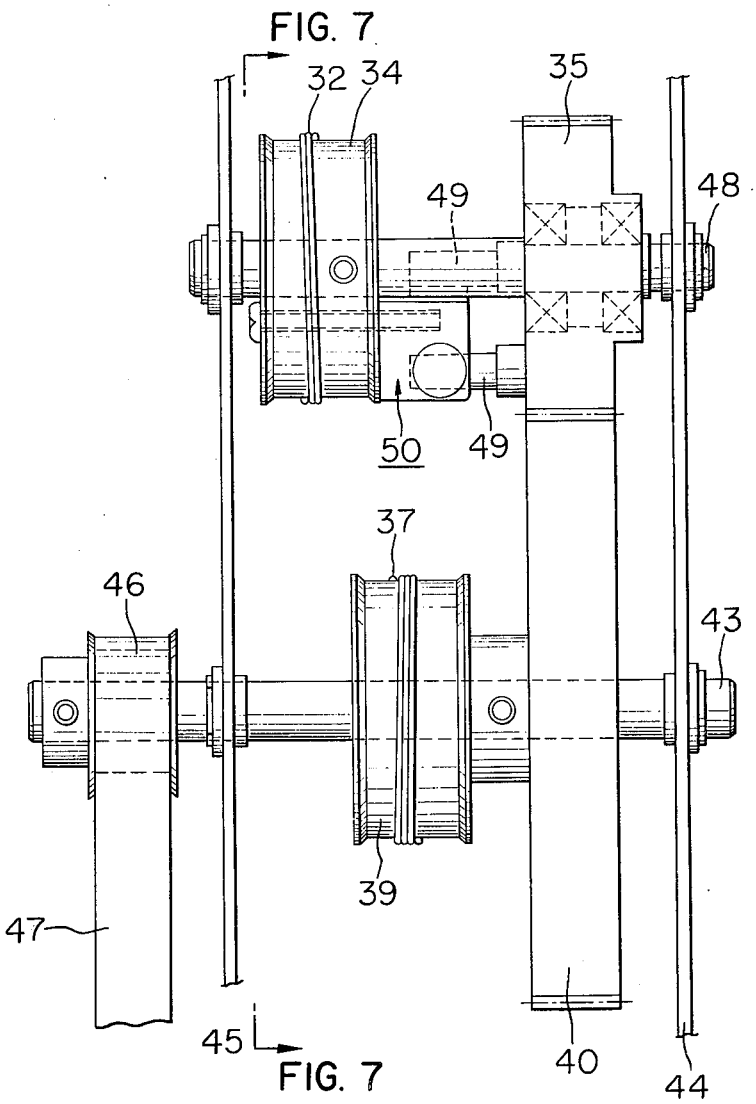
FIG. 6 is a front view of a portion of the specific moving mechanism.
Figure 7:
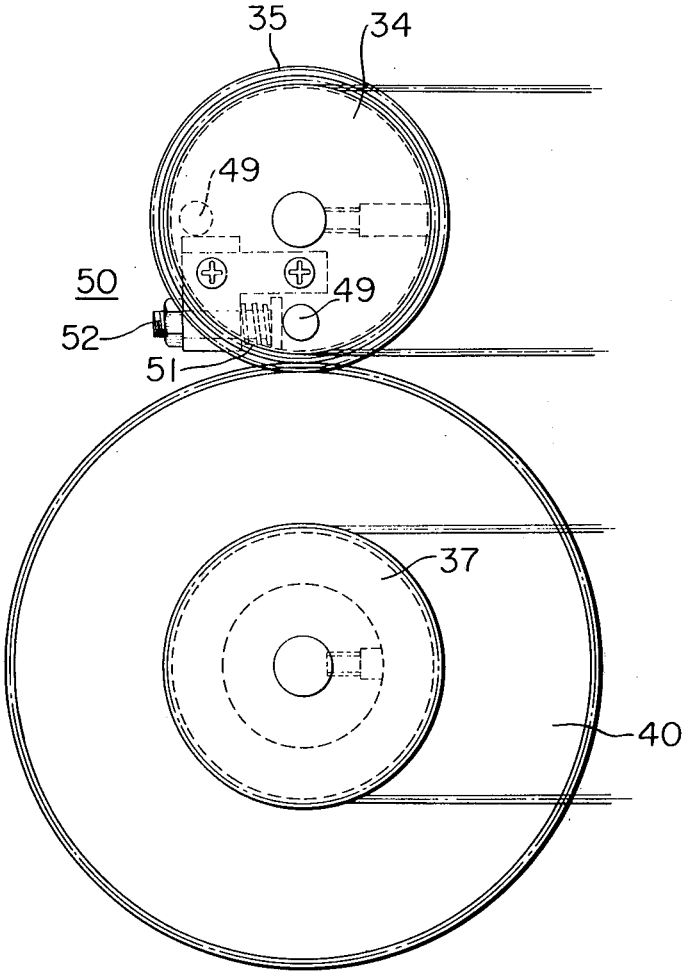
FIG. 7 is a cross-sectional side view taken along line 7–7 in FIG. 6.

FIGS. 6 and 7 are a front view and a side view, respectively, showing the two drving pulleys 34, 37 and gears 35, 40 for the two mirrors 21, 22.

A shaft 43 is rotatably journalled to two side plates 44 and 45 and has a timing pulley 46 secured to one end thereof. A timing belt 47 is passed over the timing pulley 46 to transmit the rotation of the photosensitive drum 11 to the shaft 43 through the clutchs $CL_1$ and $CL_2$. As the shaft 43 is rotated, the pulley 39 and gear 40 secured to the shaft are rotated.

Rotation of the pulley 39 may move the wire 37 for driving the second movable mirror 22 which is wrapped around the pulley 39.

Rotation of the gear 40 causes rotation of the gear 35 which is in meshing engagement with the gear 40. The gear 35 is rotatably mounted on the shaft 48.

Another shaft 48 is rotatably journalled to the two side plates 44 and 45 and has a pulley 34 securely mounted thereon.

Rotation of the gear 35 causes revolution of a pin 49 secured thereto, but initially the revolution of the pin is free relative to the pulley 34. Upon a predetermined angular rotation of the gear 35, the pin 49 actuates a stop 50 secured to the pulley 34 to thereby rotate the same pulley. The stop 50 comprises a spring 51 and a screw 52 and may absorb any shock of impact as well as effect fine angle adjustment. Rotation of the pulley 34 can move the wire 32 for driving the first movable mirror 21 which is wrapped around the pulley 34.

Figure 8:
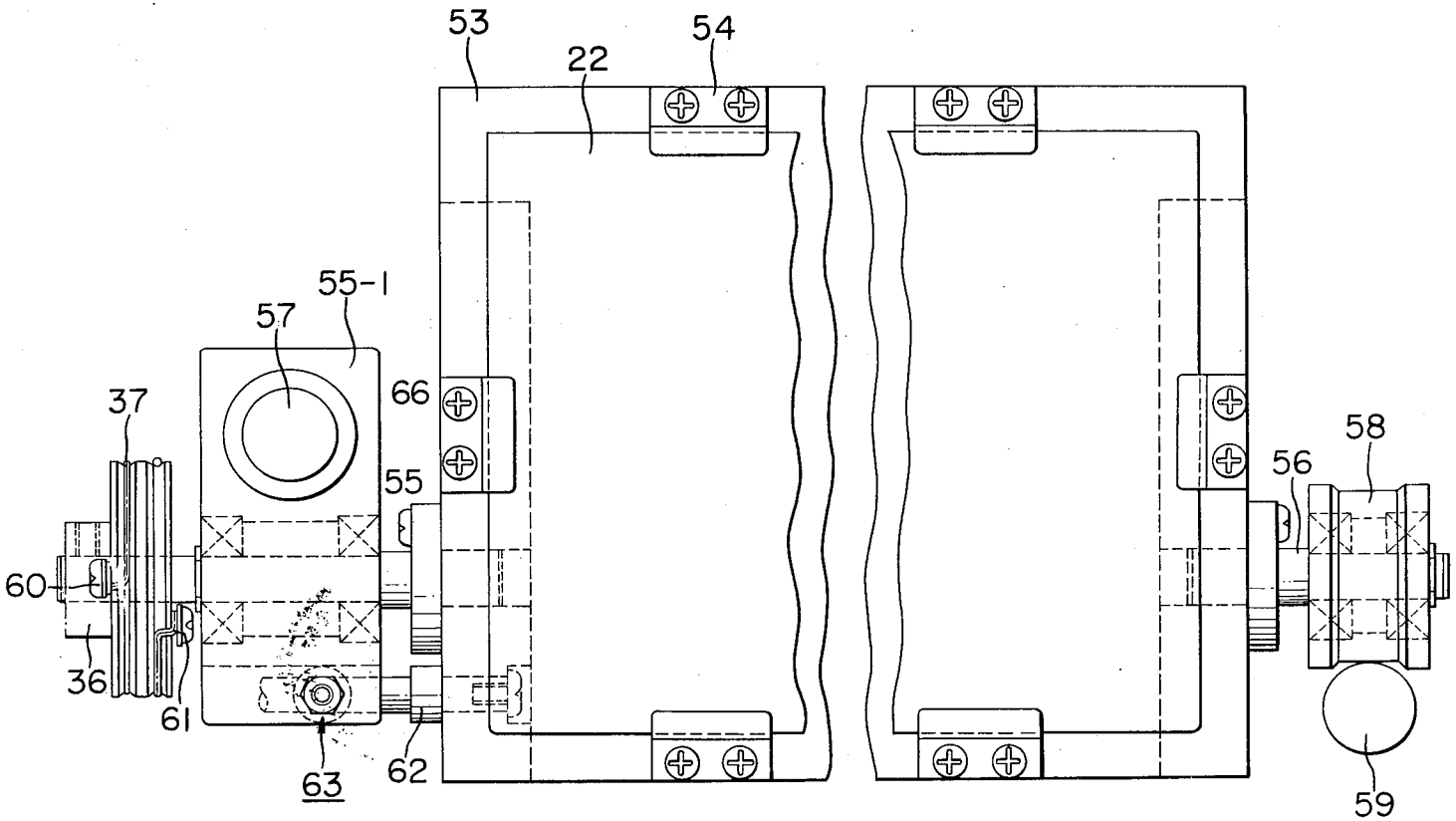
FIG. 8 is a front view of the movable mirror portion.
Figure 9:
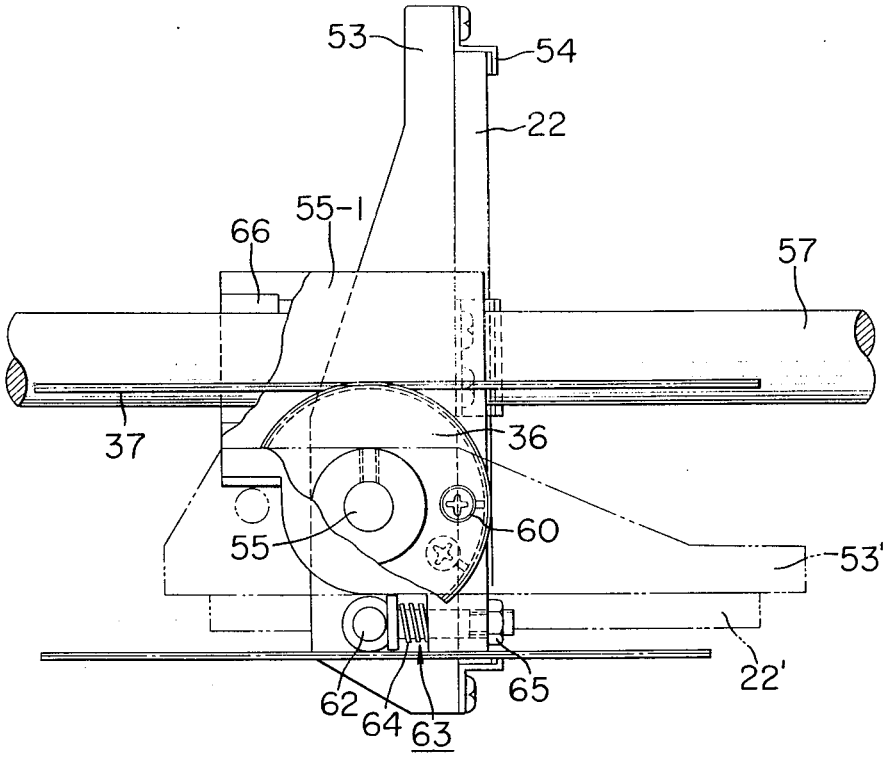
FIG. 9 is a side view corresponding to FIG. 8.

FIG. 8 illustrates the mechanism whereby the second movable mirror 22 is mounted and rotated, and FIG. 9 is a side view corresponding to FIG. 8. The second movable mirror 22 is mounted on a support 53 by means of metal fittings 54, and the support 53 has shafts 55 and 56 mounted at the opposite ends thereof. The shaft 55 also has a block 55-1 rotatably mounted thereon and the pulley 36 secured thereto. The block 55-1 is slidably mounted with respect to a rail 57.

A roller 58 is rotatably mounted on the other shaft 56 and movable on a rail 59.

The opposite ends of the wire 37 are secured to the pulley 36 so that the second movable mirror 22 may be rotated by the wire 37 being pulled.

In FIG. 9, the dots-and-dash lines indicate the initial position and the solid lines indicate the position after completion of the rotation. A pin 62 is secured to the second movable mirror 22 and may strike against a stop 63 on the block 55-1 after having made a predetermined angular rotation, thus completing the rotation of the second movable mirror. When the wire 37 is pulled, the mirror 22 is moved along the rails 57 and 59. The stop 63 comprises a spring 64 and a screw 65 and may absorb any shock of impact as well as effect fine angle adjustment. A slide bearing 66 is mounted to the block 55-1 and slidable with respect to the rails.

Figure 10:
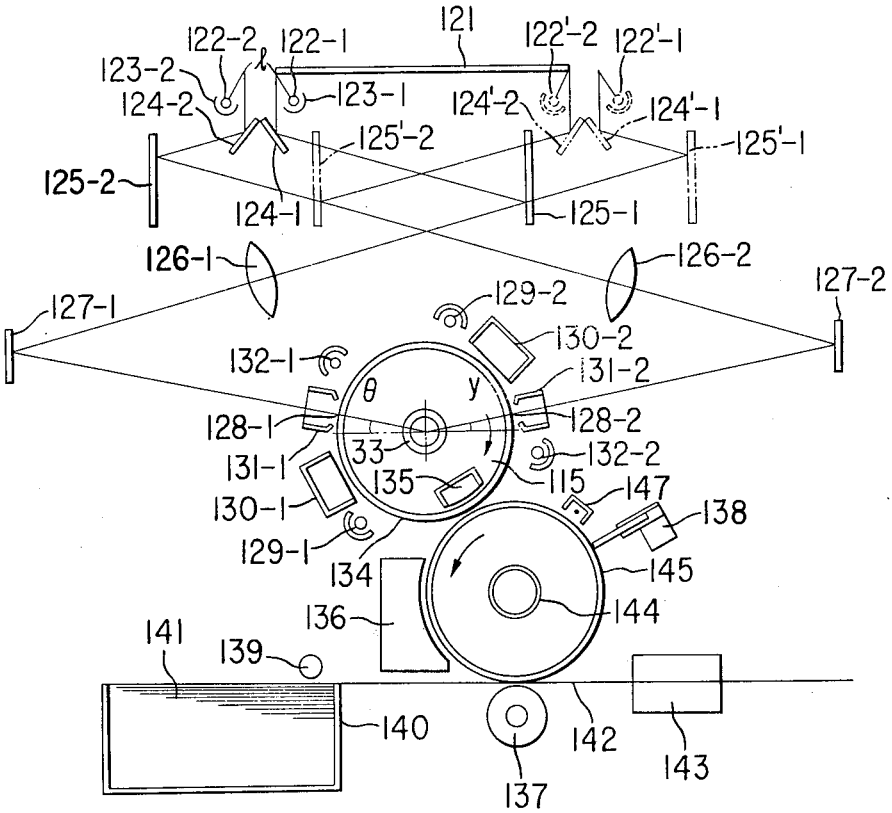
FIG. 10 is a side view of another specific embodiment of the electrophotographic apparatus according to the present invention.

FIG. 10 illustrates another specific embodiment of the electrophotographic copying apparatus which uses a photosensitive drum having two screens provided in the photosensitive medium support frame.

An original (not shown) placed on an original carriage 121 is illuminated by a set of original illuminating lamps 122-1 and 122-2 having reflectors 123-1 and 123-2 for ensuring effective utilization of the illuminating light. An image of the original is passed via a first movable mirror 124-1, a second movable mirror 125-1, a lens 126-1 and a stationary mirror 127-1 so as to be projected upon a photosensitive medium 115 at a predetermined point 128-1 thereon while, on the other hand, another image of the original is passed via a first movable mirror 124-2, a second movable mirror 125-2, a lens 126-2 and a stationary mirror 127-2 so as to be projected on the photosensitive medium 115 at another predetermined point 128-2 thereon. The surface of the photosensitive medium on which the original is imaged at the point 128-1 will be referred to as $I_1$, and the surface of the photosensitive medium on which the original is imaged at the point 128-2 will be referred to as $I_2$.

The photosensitive medium 115 is mounted on a shaft 133 and rotatable in the direction of arrow.

As it is rotated, the photosensitive medium 115 is subjected to pre-irradiation by a pre-irradiation lamp 129-1 for the surface $I_1$ and given a uniform light memory, and then subjected to pre-charge by a primary corona discharger 130-1 and to corona discharge by a secondary corona discharger 131-1 while it is subjected to the image light from the original, whereby a primary electrostatic latent image is formed on the photosensitive medium 115. To increase the contrast of this primary electrostatic latent image, the photosensitive medium 115 is further subjected to allover exposure by an allover exposure lamp 132-1. A similar process is also effected for the surface $I_2$.

Successive portions of the original are scanned to effect the formation of the primary electrostatic latent image. More specifically, the original illuminating lamp 122 and the first movable mirror 124 together scan the original and reach the positions indicated at 122' and 124', whereupon all the scanning of the original is terminated. The two original illuminating lamps 122-1, 122-2 and the two first movable mirrors 124-1, 124-2 have just the same distance of travel and the second movable mirrors 125-1, 125-2 also have the same distance of travel, and therefore all these may desirably be united together to simplify the construction of the entire apparatus.

By uniting them together, it will also become easier to accurately set the timing of the movable optical system scanning and driven in synchronism with the positions of the screens of the photosensitive medium 115.

When the image of the original is projected upon the photosensitive medium, the image light is caused to be incidents on the photosensitive medium at angles $\theta°$ and $\phi°$ with resect to the horizontal, as shown, and primary electrostatic latent images corresponding to the original image may be formed symmetrically on the surfaces $I_1$ and $I_2$ of the photosensitive medium 115 if there is maintained a relation that $l = (\theta + \phi)\ \pi D/360$, where D is the diameter of the drum and $l$ is the distance between the original illuminating lamps 124-1 and 124-2. A single lens placed at the intersection between the exposure light paths to the surfaces $I_1$ and $I_2$, will make it possible to accomplish exposures at two places simultaneously without the use of any additional lens.

An insulating drum 145 rotatably mounted on a center shaft 144 is rotatable in the direction of the arrow in synchronism with the photosensitive medium 115. The primary electrostatic latent image formed on the photosensitive medium 115 controls the ion flow resulting from the corona discharge by the corona discharger 116, to thereby form a secondary electrostatic latent image on the insulating drum 145. During the formation of the secondary electrostatic latent image, the connection between the optical system and the screen drum may be cut off to permit the screen drum to be rotated at a higher velocity than during formation of the primary electrostatic latent image. The secondary electrostatic latent image on the insulating drum 145 is developed into a visible image by a developing device 136 and transferred onto sheets of recording paper 141 which are fed one by one from a paper supply frame 140 to a transfer device 137 as by a pickup roller 139. The recording paper 141 is moved along its path 142 to reach a fixing device 143, wherein the developed image on the recording paper 141 is fixed. Any toner particles remaining on the insulating drum 145 after the image transfer are removed by a cleaning device 138, and then the insulating drum is provided with a uniform surface potential by a deelectrifier 147, whereafter the process of secondary electrostatic latent image formation and incidental procedures are repeated. Thus, any desired number of copies may be produced.

In the apparatus of the above-described construction, the two surfaces of the photosensitive medium are simultaneously subjected to image light to form primary electrostatic latent images thereon, and this means that the copy producing speed is little affected even if the velocity of movement of the photosensitive medium is relatively slowed down in order to provide especially better reproducibility of the formed image. In addition, the use of more than one primary electrostatic latent image leads to less disturbance imparted to the electrostatic images and copies can be produced without their image quality being reduced, as in the previous embodiment.

Figure 11:
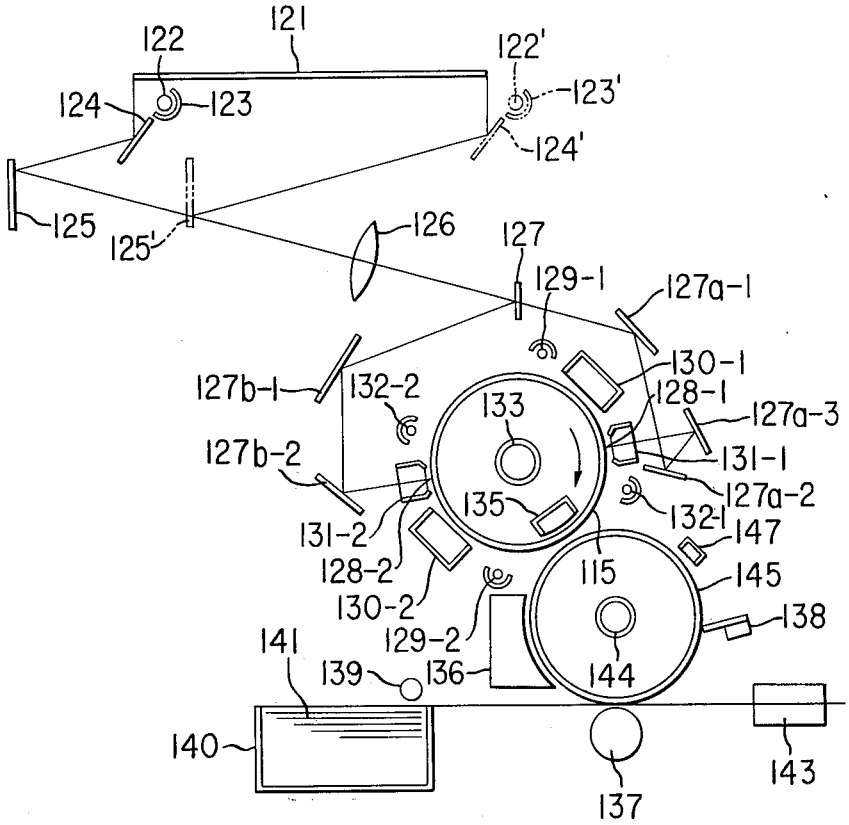
FIG. 11 is a side view of still another specific embodiment of the electrophotographic copying apparatus according to the present invention.

FIG. 11 illustrates still another specific embodiment of the copying apparatus. This embodiment is similar to the previous embodiments in using a photosensitive medium having a plurality of image forming surfaces, but it differs in that the optical scanning system comprises one set and the light path after passing through the lens system is split to enable two or more images to be formed simultaneously on the photosensitive medium.

An original (not shown) placed on an original carriage 121 is illuminated by an original illuminating lamp 122. The image of the original so illuminated is passed via a first and second movable mirrors 124 and 125 and through a lens 126 to a half-mirror 127. The light path is split into two by this half-mirror 127 so that the part of the light passed therethrough is directed via stationary mirrors **127*a*-1, 127*a*-2, 127*a*-3 to an imaging point 128-1** on a surface of the photosensitive medium.

On the other hand, the part of the light reflected by the half-mirror 127 is directed via stationary mirrors **127*b*-1, 127*b*-2 to an imaging point 128-2** on a surface of the photosensitive medium. An electrostatic latent image is formed on each of the surfaces of the photosensitve medium through process means similar to those in the previously described apparatus, whereafter the electrostatic images are successively transferred onto sheets of transfer paper, thus providing any desired number of copies.

Figure 12:
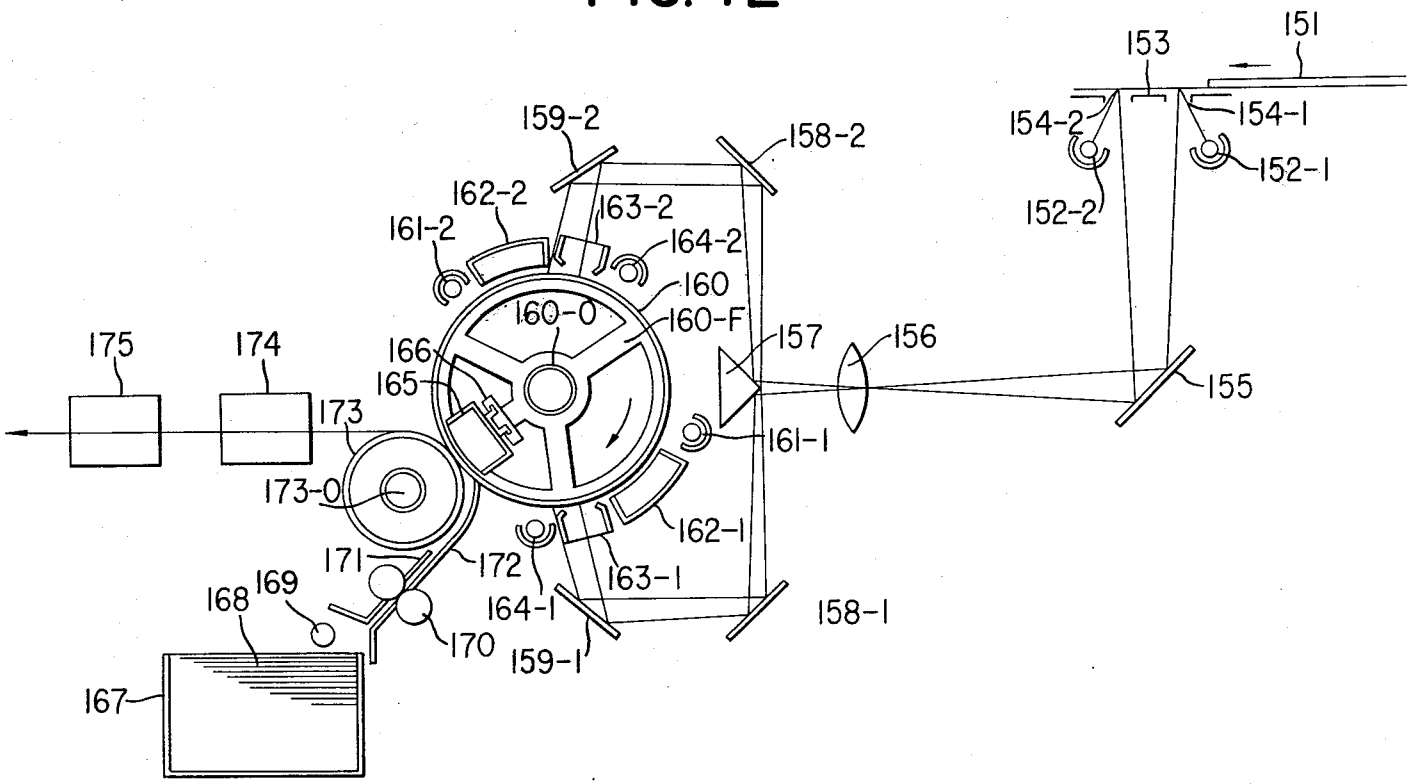
FIG. 12 is a side view of a further specific embodiment of the electrophotographic copying apparatus according to the present invention.

FIG. 12 illustrates a further specific embodiment of the copying apparatus, in which an original is moved to traverse two slits so that the image of the original is projected upon the photosensitive medium at two points thereon.

The original placed on an original carriage 151 is illuminated by illuminating lamps 152-1 and 152-2 through openings 154-1 and 154-2 of a slit 153. The image of the original so illuminated is directed via a stationary mirror 155 and a lens 156 and split into two opposite directions by a right-angled prism 157 having mirror surfaces. One of the light beams is directed via stationary mirrors 158-1 and 159-1 while the other light beam is directed via stationary mirrors 158-2 and 159-2, so that the two light beams are imaged upon a photosensitive medium 160, respectively. Each of the surfaces $I_1$ and $I_2$ of the photosensitive medium available for the image formation is given a uniform light memory by the pre-irradiation from illuminating light source 161-1, 161-2, and then uniformly charged by charger 162-1, 162-2, whereafter the two surfaces are subjected to simultaneous application of light and AC discharge or uniform charge of the opposite polarity by corona dischargers 163-1, 163-2 and thereafter, subjected to allover exposure by allover illumination sources 164-1, 164-2. Thus, electrostatic latent images are formed simultaneously on the two surfaces $I_1$ and $I_2$ of the drum-shaped photosensitive medium. This photosensitive medium may comprise, for example, a drum-shaped frame 60 having two photosensitive screens extended thereover, and rotatably mounted on flanges 160-F secured to a center shaft 160-0. Of course, the photosensitive medium is not restricted to such configuration but any desired modification thereof is possible.

The electrostatic latent images formed on the photosensitive drum surfaces $I_1$ and $I_2$ are used to form corresponding images on recording members by a corona discharger 165 removably mounted on a discharger mounting rail 166 secured to the flanges 160-F of the photosensitive drum. More specifically, recording members 168 such as sheets of electrostatic recording paper or the like are fed one by one from a paper supply table 167 toward a transfer roller 173 by means of a pickup roller 169. Each of such recording members 168 is transported through guides 171 and 172 to the transfer roller 173 in synchronism with the movement of each electrostatic latent image formed on the photosensitive medium.

The transfer roller 173 supported on a center shaft 173-0 holds the fed recording member thereon while, on the other hand, a voltage is applied to the transfer roller at least as long as the corona discharger 165 is operating, whereby formation of a secondary electrostatic latent image on the recording member is accomplished.

The electrostatic image formed on the recording member is developed into a visible image by a developing device 174, and the developed image is fixed by a fixing device 175, thus providing a final copy.

The apparatus of the present invention, as has hitherto been described with respect to its specific embodiments, can continuously effect the scanning of an original image and can therefore accomplish the formation of electrostatic latent images on the photosensitive medium in a very short time. Moreover, when applied to an arrangement which uses the screen process or the like capable of retention copying, the present invention can achieve higher speed of copying and this is highly effective.

We claim:

1. In an electrophotographic copying apparatus for forming on a photosensitive medium electrostatic images corresponding to an original to provide copies thereof, an improvement comprising:

an original carriage for carrying thereon the original;

optical scanning means having a plurality of reciprocally movable optical scanning units for scanning the original carried on said original carriage, wherein each of said optical scanning units has a first and a second reciprocally movable mirror, and wherein each said first mirror moves simultaneously with its corresponding second mirror at a velocity ratio of 2 : 1;

a photosensitive medium; and means for projecting the scanned image on said photosensitive medium, and means including a charger for forming on said photosensitive medium electrostatic images corresponding to the original scanned by said optical scanning means;

said optical scanning units of said optical scanning means being operable to successively scan said original.

2. An electrophotographic copying apparatus according to claim 1, wherein a said second movable mirror of at least one of said scanning units is rotatably mounted for rotation to a position outside the light path of another said unit during an inoperative condition of said one unit.

3. In an electrophotographic copying apparatus for forming on a photosensitive medium electrostatic images corresponding to an original to provide copies thereof, the improvement comprising:

an original carriage for carrying thereon the original;

optical scanning means having a plurality of reciprocally movable optical scanning units for scanning the original carried on said original carriage, wherein each of said optical scanning units has a first and a second reciprocally movable mirror, and wherein each said first mirror moves simultaneously with its corresponding second mirror at a velocity ratio of 2 : 1;

a photosensitive screen medium having image-forming surfaces corresponding in number to said optical scanning units;

said optical scanning units of said optical scanning means being operable to successively scan the original to form corresponding images on said image-forming surfaces of said photosensitive screen medium;

means including a charger for forming on said photosensitive medium electrostatic images corresponding to the original scanned by said optical scanning means; and means for visualizing copy images corresponding to said electrostatic images.

4. An electrophotographic copying apparatus according to claim 3, wherein a said second movable mirror of at least one of said scanning units is rotatably mounted for rotation to a position outside the light path of another said unit during an inoperative condition of said one unit.

5. An electrophotographic copying apparatus for forming on a photosensitive medium electrostatic images corresponding to an original to provide copies thereof, comprising:

an original carriage for carrying thereon the original;

optical scanning means including a plurality of optical scanning units each having a first and a second movable mirror reciprocally movable to scan said original on said original carriage, wherein each said first mirror moves simultaneously with its corresponding second mirror at a velocity ratio of 2 : 1;

a photosensitive medium;

means for projecting the scanned image on said photosensitive medium, and means including a charger for forming on said photosensitive medium electrostatic images corresponding to the original scanned by said optical scanning means; and means for visualizing copy images corresponding to the electrostatic images formed on said photosensitive medium.

6. An electrophotographic copying apparatus according to claim 5, wherein said optical scanning units of said optical scanning means are arranged in a row at one end of said original carriage along the path of reciprocating movement so that, when a first of said optical scanning units is moving forward for scanning, a subsequent one of said optical scanning units is maintained outside the light path and when said first optical scanning unit completes the scanning, said subsequent optical scanning unit starts scanning.

7. An electrophotographic copying apparatus according to claim 6, wherein the second movable mirror of each of the optical scanning units subsequent to said first optical scanning unit is rotatably mounted and is normally maintained in its position outside the light path of the prior unit, and is raised up prior to its start of scanning.

* * * * *